US011548712B2

(12) United States Patent
Nash et al.

(10) Patent No.: US 11,548,712 B2
(45) Date of Patent: Jan. 10, 2023

(54) DRINKS POUCH

(71) Applicant: HandiPak Holdings Ltd, Bexleyheath (GB)

(72) Inventors: Julian Nash, Byfleet (GB); Ryan Horn, London (GB); Cyril Norman Phillips, Longfield (GB)

(73) Assignee: HANDIPAK HOLDINGS LTD, Kent (GB)

( * ) Notice: Subject to any disclaimer, the term of this patent is extended or adjusted under 35 U.S.C. 154(b) by 578 days.

(21) Appl. No.: 16/466,684

(22) PCT Filed: Dec. 5, 2017

(86) PCT No.: PCT/GB2017/000173
§ 371 (c)(1),
(2) Date: Jun. 5, 2019

(87) PCT Pub. No.: WO2018/104692
PCT Pub. Date: Jun. 14, 2018

(65) Prior Publication Data

US 2019/0337701 A1 Nov. 7, 2019

(30) Foreign Application Priority Data

Dec. 5, 2016 (GB) ..... 1620689
Jun. 28, 2017 (GB) ..... 1710293
(Continued)

(51) Int. Cl.
*B65D 75/54* (2006.01)
*B65D 75/58* (2006.01)
(Continued)

(52) U.S. Cl.
CPC ..... *B65D 77/283* (2013.01); *B65D 75/008* (2013.01); *B65D 75/5816* (2013.01); *B65D 75/5822* (2013.01); *B65D 75/5855* (2013.01)

(58) Field of Classification Search
CPC .... B65D 77/28; B65D 77/283; B65D 77/286; B65D 75/5866; B65D 75/5855
(Continued)

(56) References Cited

U.S. PATENT DOCUMENTS 2,992,118 A 7/1961 Daline
3,144,976 A 8/1964 Freshour
(Continued)

FOREIGN PATENT DOCUMENTS

CM 2488 A1 11/1999
DE 7409493 U 6/1974
(Continued)

OTHER PUBLICATIONS

KR20030020688ATranslation (Year: 2003).*
(Continued)

*Primary Examiner* — Jes F Pascua
*Assistant Examiner* — Nina K Attel
(74) *Attorney, Agent, or Firm* — Hamre, Schumann, Mueller & Larson, P.C.

(57) ABSTRACT

A fully sealed pouch containing a drink is provided with a straw within the pouch accessible to allow a user to draw drink from the pouch. The pouch defines a top portion, a bottom portion, and respective side edges interconnecting the top portion and the bottom portion. A corner portion is defined between the top portion and one side edge, the corner portion being openable by a user to access the straw. The pouch forms a closed cavity containing the drink, the cavity being defined by the top portion, the bottom portion, and side edges and by at least one wall defining a front face and a rear face for the cavity. The front and rear faces are connected together in the top portion. The front and rear faces are continuous with each other at, or are connected along, the other of the side edges. The front and rear faces
(Continued)

are connected, optionally via a gusset, to provide the bottom portion. The one side edge is formed by a first heat seal connecting the front and rear faces; and a second heat seal connects the front and rear faces and extends in an incomplete fashion from the top portion to the bottom portion, being spaced inboard of the first heat seal. The second heat seal divides the interior of the cavity into major and minor portions interconnected so that drink may flow between them, the minor portion lying between the first and second heat seals, and the straw being located within this minor portion. A number of different ways are described in which the corner portion may be opened along a line of weakness formed in the pouch and extending generally parallel to the bottom portion from the first heat seal to and ending at the second heat seal.

9 Claims, 10 Drawing Sheets

(30) Foreign Application Priority Data

Jun. 28, 2017 (GB) ..... 1710296
Jun. 28, 2017 (GB) ..... 1710298
Jun. 28, 2017 (GB) ..... 1710300

(51) Int. Cl.
*B65D 77/28* (2006.01)
*B65D 75/00* (2006.01)

(58) Field of Classification Search
USPC ..... 426/85; 206/217; 220/705; 53/133.3; 383/210, 210.1, 211, 200, 203, 207, 208
See application file for complete search history.

(56) References Cited

U.S. PATENT DOCUMENTS

| | | | | |
|---|---|---|---|---|
| 3,663,239 | A | 5/1972 | Rowe et al. | |
| 3,815,810 | A | 6/1974 | Wellman | |
| 4,119,128 | A | 10/1978 | Bishop | |
| 5,884,758 | A | 3/1999 | Sigouin et al. | |
| 6,293,394 | B1 | 9/2001 | Marbler et al. | |
| 6,912,825 | B2 | 7/2005 | Kothari | |
| 2003/0012851 | A1 | 1/2003 | Kuge et al. | |
| 2003/0075560 | A1 | 4/2003 | Lee | |
| 2003/0221393 | A1 | 12/2003 | Kothari | |
| 2007/0177828 | A1 | 8/2007 | Takada et al. | |
| 2011/0293207 | A1 | 12/2011 | Edwards et al. | |
| 2015/0048112 | A1 | 2/2015 | Skillin et al. | |
| 2015/0090740 | A1* | 4/2015 | Barton | B65D 75/327 222/211 |
| 2018/0319562 | A1 | 11/2018 | Rodman | |

FOREIGN PATENT DOCUMENTS

| | | | | |
|---|---|---|---|---|
| EP | 0658488 | | | 6/1995 |
| EP | 1136379 | A1 | | 9/2001 |
| EP | 1175351 | A1 | | 1/2002 |
| EP | 1223114 | A1 | | 7/2002 |
| EP | 0997393 | B1 | | 2/2003 |
| EP | 1291295 | A1 | | 3/2003 |
| GB | 980859 | A | * | 1/1965 |
| GB | 2473546 | | | 3/2011 |
| JP | S5780437 | U | | 5/1982 |
| JP | H08337255 | A | | 12/1996 |
| KR | 20030020688 | A | * | 3/2003 |
| KR | 1020070041693 | A | | 4/2007 |
| KR | 20110037186 | A | * | 4/2011 |
| WO | 2016124881 | A1 | | 8/2016 |
| WO | 2018104692 | A1 | | 6/2018 |

OTHER PUBLICATIONS

KR20110037186ATranslation (Year: 2011).*
International Search Report and Written Opinion issued in PCT/GB2019/000035, dated May 17, 2019, 8 pages provided.
Search Report issued in GB1902588.1, dated Aug. 6, 2019, 1 page provided.
International Search Report and Written Opinion of PCT/GB2017/000173, dated Mar. 27, 2018, 14 pages provided.
Examination Report issued in European Application No. 17817816.6, dated Jul. 6, 2020.
International Preliminary Report on Patentability issued in PCT/GB2017/000173 dated Jun. 11, 2019, 13 pages provided.
Office Action issued for U.S. Appl. No. 16/975,825, dated May 11, 2022, 22 pages.

* cited by examiner

DRINKS POUCH

BACKGROUND

This disclosure relates to drinks pouches.

Drinks pouches with a weakened corner portion that may be wholly or partially detached to allow access to the contents are well known, but difficult, especially for young children, to drink from. Drinks suppliers have often resorted to providing a straw held by adhesive on one face of the pouch, but removable therefrom and intended to be inserted into the opening created at the corner portion. The straws may be accidentally detached, and thus lost.

A more recent development (see, for example, U.S. Pat. No. 5,884,758 of Sigouin et al, U.S. Pat. No. 6,912,825 of Kothari, EP 1175351 of Beveraggi and WO 2016/124881 of Discovery Flexibles Ltd) has been to package the straw within the pouch. However, the pouch must necessarily be opened in order to access the straw.

A problem, whenever a pouch containing drink is opened is, as far as possible, to avoid spillage. However carefully a pouch is opened, there is an evident danger of subsequent spillage when removing a straw stuck to a face of the pouch if this is done after the pouch has been opened. With pouches that need a portion to be torn off to reach a straw within, there is a danger of spillage when making the tear to reach the straw. The present inventor's experience working with pouches of the kind described in WO 2016/124881 is that, even when a line of weakness is provided between a side edge of the pouch and a top edge of the pouch, the tear from the side to the top may sometimes continue right across the top of the pouch, so that the contents spill. Even worse would be the case of tearing from the top edge towards the side edge if the tear continues down the side.

The present disclosure has arisen from work seeking to overcome or reduce the occurrence of these problems.

SUMMARY OF THE DISCLOSURE

In accordance with one aspect of the present disclosure, there is provided: a fully sealed pouch containing a drink, and provided with a straw within the pouch accessible to allow a user to draw drink from the pouch; the pouch defining a top portion, a bottom portion, and respective side edges interconnecting the top portion and the bottom portion, and a corner portion defined between the top portion and one said side edge, the corner portion being openable by a user to access the straw; the pouch forming a closed cavity containing said drink, the cavity being defined by said top portion, said bottom portion, and said side edges and by at least one wall defining a front face and a rear face for the cavity, the front and rear faces being connected together in said top portion, the front and rear faces being continuous with each other at, or being connected along, the other of said side edges, the front and rear faces being connected, optionally via a gusset, to provide said bottom portion, and said one side edge being formed by a first heat seal connecting the front and rear faces; and a second heat seal connecting the front and rear faces and extending in an incomplete fashion from the top portion to the bottom portion and being spaced inboard of the first heat seal, the second heat seal dividing the interior of the cavity into major and minor portions interconnected so that drink may flow between them, the minor portion lying between the first and second heat seals, and the straw being located within said minor portion; and the corner portion being openable along a line of weakness formed in said pouch and extending generally parallel to the bottom portion from the first heat seal to and ending at the second heat seal.

In one embodiment, there is provided a pouch containing a drink, and provided with a straw within the pouch accessible to allow a user to draw drink from the pouch; the pouch defining a top edge, a bottom portion, and respective side edges interconnecting the top edge and the bottom portion, and a corner portion defined between the top edge and one said side edge, the corner portion being openable by a user to access the straw; the pouch forming a closed cavity containing said drink, the cavity being defined by said top edge, said bottom portion, and said side edges and by at least one wall defining a front face and a rear face for the cavity, the front and rear faces being connected along said top edge, the front and rear faces being continuous with each other at or being connected along the other of said side edges, the front and rear faces being connected, optionally via a gusset, to provide said bottom portion, and said one side edge being formed by a first heat seal connecting the front and rear faces; a second heat seal connecting the front and rear faces, and extending from the top edge generally in a direction towards the bottom portion parallel to and spaced from the first seal, the second seal dividing the interior of the cavity into major and minor portions interconnected so that drink may flow between them, the minor portion lying between the first and second seals, and the straw being located within said minor portion; the corner portion being openable along a line of weakness formed in said pouch and extending generally parallel to the top edge from the first heat seal to and ending at the second heat seal.

Preferred arrangements have one or more of the following features: The top portion has a top edge defined by a third heat seal interrupted by a cut at the second heat seal and dividing the top edge into a minor heat seal portion extending from said first heat seal to said second heat seal and a major heat seal portion separated from said minor heat seal portion and extending from said second heat seal to the other of said side edges, and said line of weakness extends from the one side edge to the cut, whereby said corner portion is openable by tearing along said line of weakness from said one side edge to said cut. The second heat seal is bifurcated at its end adjacent the top edge to form a first branch extending to the minor heat seal portion in the corner portion and a second branch extending to the major heat seal portion, the cut extending between the two branches, whereby said corner portion is openable by tearing along said line of weakness from said one side edge to the said first branch in said cut.

Alternatively, the top portion has a top edge defined by a third heat seal extending from the one to the other of the side edges, the second heat seal terminates short of the top edge at an enlarged abutment connecting the front and rear faces, and the line of weakness extends from said one side edge and terminates at said abutment which forms an anchor for the line of weakness, whereby said corner portion is openable by tearing along said line of weakness from said one side edge to said abutment. The top portion is provided with a fold line extending from said abutment to said top edge, whereby said corner portion remains attached to the remainder of the pouch along the fold line following tearing along said line of weakness, but may be folded out of the way along the fold line when a user accesses the straw to drink from the pouch.

In another alternative, the top portion has a top edge defined by a third heat seal extending from the one to the other of the side edges, the corner portion has a corner where the top edge and the one side edge meet, and wherein the strength of the first and third heat seals in the corner portion is substantially less than the strength of the remainder of the first and third heat seals, whereby the corner portion may be opened by peeling the front and rear faces apart from the said corner in the corner portion along the lesser strength portions of the first and third seals, and tearing along the line of weakness, to leave the peeled apart portions of the front and rear faces still attached to the remainder of the pouch.

Preferred arrangements may also have one or more of the following features: The second heat seal terminates short of the bottom portion to allow passage between the major and minor portions of the cavity. The second heat seal is interrupted by gaps allowing passage between the major and minor portions of the cavity. The straw is bonded to said at least one wall, whereby the straw is fixed in position within the pouch at least until located by a user after opening the corner portion. The pouch is formed from a heat bondable pliant packaging material in laminate form, and the straw has a first end and a second end and is bonded to at least one surface interior of the pouch selected from surfaces of said front and rear surfaces interior of the pouch at a portion of the straw intermediate its ends. The first end of the straw is located adjacent the top portion of the pouch, and the straw has a longitudinally expandable portion, preferably a concertina portion that also allows the straw to be bent. The expandable portion is located between said intermediate portion and the first end of the straw. The line of weakness is defined by an elongate tear strip formed of a material more resistant to tearing than the remainder of the material of the pouch and incorporated into that material to extend along the line of weakness at least from a position at or adjacent the first heat seal to a position at or adjacent to the second heat seal, the tear strip having a graspable free distal end portion extending out of the remaining material of the pouch, whereby the corner portion can be opened by pulling the free distal end portion to tear the pouch along the line of weakness.

The tear strip may extend from first heat seal to the second heat seal on one of the front face and the rear face and exits the remaining material of the pouch at or adjacent the second heat seal to provide said distal end portion. Alternatively, the tear strip may extend from a position at or adjacent the second heat seal on one of the front face and the rear face to a position at or adjacent the first heat seal, and then to a position at or adjacent the second heat seal on the other of the front face and rear face, and exits the remaining material of the pouch on said other of the front face and rear face at or adjacent the second heat seal to provide said distal end portion.

The tear strip is made of a generally flat elongate strip of polymer. Alternatively, the tear strip is formed from a twisted or woven thread material.

The pouch is suitably formed from a heat bondable pliant packaging material in laminate form, and the tear strip is incorporated between layers of said laminate form packaging material during formation of said material.

In an alternative arrangement, the line of weakness may be formed both in the front face and in the rear face and extend from the first heat seal to and end at the second heat seal, the line of weakness being formed as dotted or dashed lines laser etched into the exterior surfaces of the front and rear faces.

According to a second embodiment, there is provided: a pouch containing a drink, and provided with a straw within the pouch accessible to allow a user to draw drink from the pouch; the pouch defining a top edge, a bottom portion, and respective side edges interconnecting the top edge and the bottom portion, and a corner portion defined between the top edge and one said side edge, the corner portion being openable by a user to access the straw; the pouch forming a closed cavity containing the drink, the cavity being defined by the top edge, the bottom portion, and the side edges and by at least one wall defining a front face and a rear face for the cavity, the front and rear faces being connected along the top edge, the front and rear faces being continuous with each other at or being connected along the other of the said side edges, the front and rear faces being connected, optionally via a gusset, to provide the bottom portion, and the one side edge being formed by a first heat seal connecting the front and rear faces; a second heat seal connecting the front and rear faces, and extending from the top edge generally in a direction towards the bottom portion parallel to and spaced from the first seal, the second seal dividing the interior of the cavity into major and minor portions interconnected so that drink may flow between them, the minor portion lying between the first and second seals; and the straw being located within said minor portion, and being bonded to said at least one wall, and the corner portion being openable along a line of weakness formed in the pouch and extending generally parallel to the top edge from the first heat seal to and ending at the second heat seal, whereby the straw is fixed in position within the pouch at least until located by a user after opening said corner.

Preferred arrangements of this embodiment have one or more of the following features: The pouch is formed from a heat bondable pliant packaging material in laminate form, and the straw is bonded to a surface of said at least one wall interior of the pouch defined by said laminate form at a position intermediate the ends of the straw. The straw has a longitudinally expandable portion positioned between said intermediate position and the top edge, whereby the straw may be extended beyond the top edge by expanding said expandable portion after opening said corner.

According to a third embodiment, there is provided: a pouch containing a drink, and provided with a straw within the pouch accessible to allow a user to draw drink from the pouch; the pouch defining a top edge, a bottom portion, and respective side edges interconnecting the top edge and the bottom portion, and a corner portion defined between the top edge and one said side edge, the corner portion being openable by a user to access the straw; the pouch forming a closed cavity containing the drink, the cavity being defined by the top edge, the bottom portion, and the side edges and by at least one wall defining a front face and a rear face for the cavity, the front and rear faces being connected along the top edge, the front and rear faces being continuous with each other at or being connected along the other of the said side edges, the front and rear faces being connected, optionally via a gusset, to provide the bottom portion, and the one side edge being formed by a first heat seal connecting the front and rear faces; a second heat seal connecting the front and rear faces, and extending from the top edge generally in a direction towards the bottom portion parallel to and spaced from the first seal, the second seal dividing the interior of the cavity into major and minor portions interconnected so that drink may flow between them, the minor portion lying between the first and second seals, and the straw being located within said minor portion; and the corner portion being openable along a line of weakness formed in the pouch and extending generally parallel to the top edge from the first heat seal to and ending at the second heat seal; and the straw comprising a longitudinally expandable portion; whereby the straw may be extended beyond said top edge after opening said corner by longitudinal expansion by a user of said longitudinally expandable portion.

According to a fourth embodiment, there is provided: a pouch containing a drink, and provided with a straw within the pouch accessible to allow a user to draw drink from the pouch; the pouch defining a top edge, a bottom portion, and respective side edges interconnecting the top edge and the bottom portion, and a corner portion defined between the top edge and one said side edge, the corner portion being openable by a user to access the straw; the pouch forming a closed cavity containing the drink, the cavity being defined by the top edge, the bottom portion, and the side edges and by at least one wall defining a front face and a rear face for the cavity, the front and rear faces being connected along the top edge, the front and rear faces being continuous with each other at or being connected along the other of the side edges, the front and rear faces being connected, optionally via a gusset, to provide the bottom portion, and the one side edge being formed by a first heat seal connecting the front and rear faces; a second heat seal connecting the front and rear faces, and extending from the top edge generally in a direction towards the bottom portion parallel to and spaced from the first seal, the second seal dividing the interior of the cavity into major and minor portions interconnected so that drink may flow between them, the minor portion lying between the first and second seals, and the straw being located within this minor portion; the corner portion being openable along a line of weakness formed in the pouch and extending generally parallel to the top edge from the first heat seal to and ending at the second heat seal, the line of weakness being defined by an elongate tear strip formed of a material more resistant to tearing than the remainder of the material of the pouch and incorporated into that material to extend along the line of weakness at least from a position at or adjacent the first heat seal to a position at or adjacent to the second heat seal, the tear strip having a graspable free distal end portion extending out of the remaining material of the pouch, whereby the corner portion can be opened by pulling the free distal end portion to tear the pouch along the line of weakness.

Preferred arrangements of this embodiment have one or more of the following features: The tear strip extends from first heat seal to the second heat seal on one of the front face and the rear face and exits the remaining material of the pouch at or adjacent the second heat seal to provide said distal end portion. The tear strip extends from a position at or adjacent the second heat seal on one of the front face and the rear face to a position at or adjacent the first heat seal, and then to a position at or adjacent the second heat seal on the other of the front face and rear face, and exits the remaining material of the pouch on said other of the front face and rear face at or adjacent the second heat seal to provide said distal end portion. The tear strip is made of a generally flat elongate strip of polymer. Alternatively, the tear strip is formed from a twisted or woven thread material. The pouch is formed from a heat bondable pliant packaging material in laminate form, and the tear strip is incorporated between layers of said laminate form packaging material during formation of said material.

According to a fifth embodiment, there is provided: a pouch containing a drink, and provided with a straw within the pouch accessible to allow a user to draw drink from the pouch; the pouch defining a top edge, a bottom portion, and respective side edges interconnecting the top edge and the bottom portion, and a corner portion defined between the top edge and one said side edge, the corner portion being openable by a user to access the straw; the pouch forming a closed cavity containing the drink, the cavity being defined by the top edge, the bottom portion, and the side edges and by at least one wall defining a front face and a rear face for the cavity, the front and rear faces being connected along the top edge, the front and rear faces being continuous with each other at or being connected along the other of the said side edges, the front and rear faces being connected, optionally via a gusset, to provide the bottom portion, and the one side edge being formed by a first heat seal connecting the front and rear faces; a second heat seal connecting the front and rear faces, and extending from the top edge generally in a direction towards the bottom portion parallel to and spaced from the first seal, the second seal dividing the interior of the cavity into major and minor portions interconnected so that drink may flow between them, the minor portion lying between the first and second seals, and the straw being located within this minor portion; the front and rear faces defining respective interior faces in contact with the drink and respective external surfaces, and the corner portion being openable along a line of weakness formed both in the front face and in the rear face generally parallel to the top edge from the first heat seal to and ending at the second heat seal, the line of weakness being formed as dotted or dashed lines laser etched into the exterior surfaces of the front and rear faces.

According to a sixth embodiment, there is provided: a pouch containing a drink, and provided with a straw within the pouch accessible to allow a user to draw drink from the pouch; the pouch defining a top edge, a bottom portion, and respective side edges interconnecting the top edge and the bottom portion, and a corner portion defined between the top edge and one said side edge, the corner portion being openable by a user to access the straw; the pouch forming a closed cavity containing said drink, the cavity being defined by said top edge, said bottom portion, and said side edges and by at least one wall defining a front face and a rear face for the cavity, the front and rear faces being connected along said top edge, the front and rear faces being continuous with each other at or being connected along the other of said side edges, the front and rear faces being connected, optionally via a gusset, to provide said bottom portion, and said one side edge being formed by a first heat seal connecting the front and rear faces; a second heat seal connecting the front and rear faces, and extending from an enlarged abutment joining the front and rear faces at a position short of the top edge generally in a direction towards the bottom portion parallel to and spaced from the first seal, the second seal dividing the interior of the cavity into major and minor portions interconnected so that drink may flow between them, the minor portion lying between the first and second seals, and the straw being located within said minor portion; and a line of weakness formed in said pouch and extending generally parallel to the bottom edge from the first heat seal to and terminating at the abutment which forms an anchor for the line of weakness, whereby said corner portion is openable by tearing along said line of weakness from said one side edge to said abutment.

A fold line may extend from said abutment to said top edge, whereby said corner portion remains attached to the remainder of the pouch along the fold line following tearing along said line of weakness, but may be folded out of the way along the fold line when a user accesses the straw to drink from the pouch.

According to a seventh embodiment, there is provided: a pouch containing a drink, and provided with a straw within the pouch accessible to allow a user to draw drink from the pouch; the pouch defining a top edge, a bottom portion, and respective side edges interconnecting the top edge and the bottom portion, and a corner portion defined between the top edge and one said side edge, the corner portion being openable by a user to access the straw; the pouch forming a closed cavity containing said drink, the cavity being defined by said top edge, said bottom portion, and said side edges and by at least one wall defining a front face and a rear face for the cavity, the front and rear faces being connected along said top edge, the front and rear faces being continuous with each other at or being connected along the other of said side edges, the front and rear faces being connected, optionally via a gusset, to provide said bottom portion, and said one side edge being formed by a first heat seal connecting the front and rear faces; a second heat seal connecting the front and rear faces, and extending from an enlarged abutment short of the top edge generally in a direction towards the bottom portion parallel to and spaced from the first seal, the second seal dividing the interior of the cavity into major and minor portions interconnected so that drink may flow between them, the minor portion lying between the first and second seals, and the straw being located within said minor portion; the corner portion having a corner where the top edge and the one side edge meet, the strength of the first and third heat seals in the corner portion being substantially less than the strength of the remainder of the first and third heat seals, whereby the corner portion may be opened by peeling the front and rear faces apart from the said corner in the corner portion along the lesser strength portions of the first and third seals, and tearing along the line of weakness, to leave the peeled apart portions of the front and rear faces still attached to the remainder of the pouch.

A secondary heat seal may extend between the front and rear faces from the abutment to the top edge, the peel apart lesser strength portions of the first and third heat seals respectively extending from the corner to the line of weakness and from the corner to the join between the third heat seal and the secondary heat seal at the top edge.

BRIEF DESCRIPTION OF THE DRAWINGS

Reference may now be made to the accompanying drawings which illustrate various preferred embodiment of pouch, by way of example only, in which.

DESCRIPTION OF PREFERRED EMBODIMENTS

Figure 1:
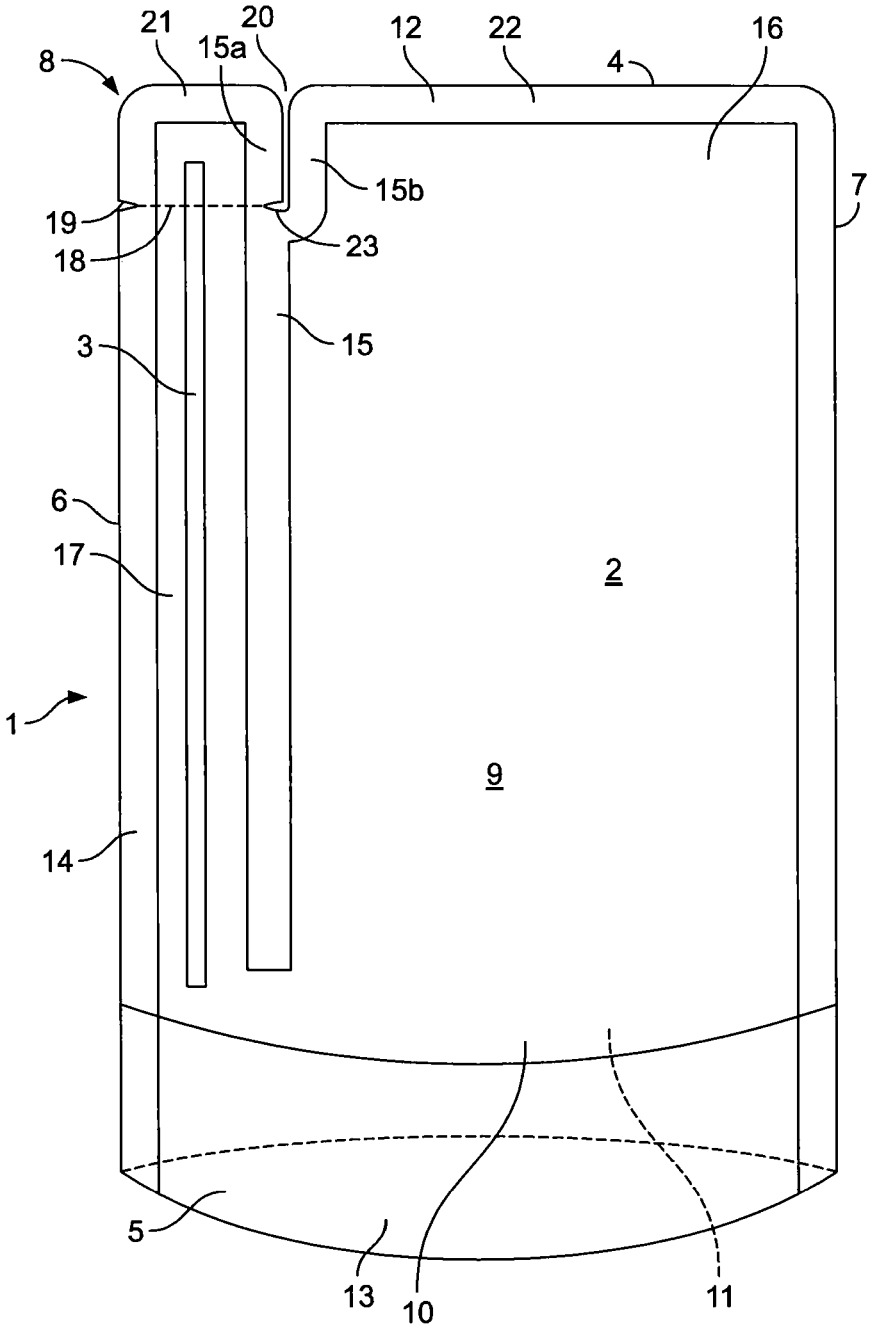
FIG. 1 shows a front elevational view of a filled pouch.
Figure 2:
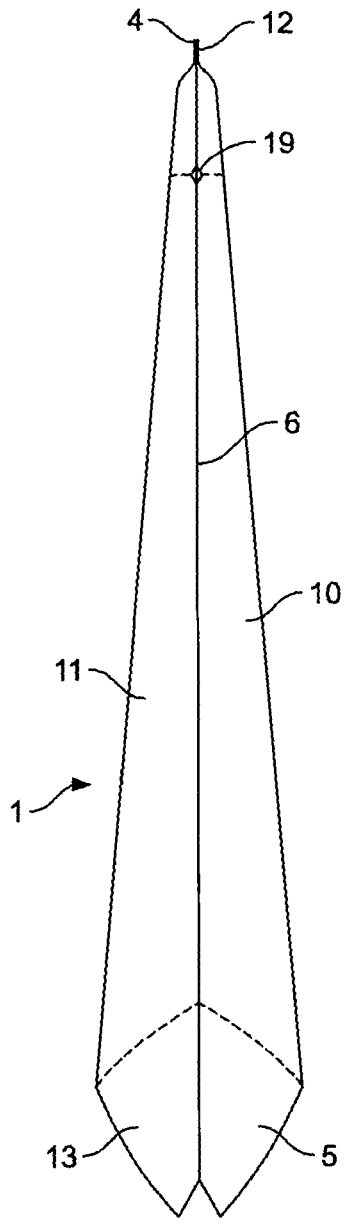
FIG. 2 shows a side elevational view of the filled pouch of FIG. 1 as seen from the left in that Figure.
Figure 3:
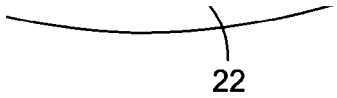
FIG. 3 shows a top plan view of the filled pouch of FIGS. 1 and 2.

Pouch 1 shown in FIGS. 1 to 3 contains a drink 2, and is provided with a straw 3 within the pouch accessible to allow a user to draw drink from the pouch. The pouch defines a top edge 4, a bottom portion 5, and respective side edges 6 and 7 which interconnect the top edge 4 and the bottom portion 5. A corner portion 8 is defined between the top edge 4 and side edge 6 for a purpose to be explained below.

The pouch 1 forms a closed cavity 9 containing drink 2. The cavity 9 is defined by the top edge 4, the bottom portion 5, and the side edges 6 and 7. It is formed by two walls made of a heat bondable pliant packaging material to form a front face 10 and a rear face 11 for the cavity 9. Suitable such packaging materials, both transparent and opaque are well known in the packaging industries and readily available commercially. They are commonly formed in a laminate form to achieve a desired mix of strength, reliability, sealability and shelf-life. It will readily be understood that front 10 and rear 11 faces could just as well be formed by a single continuous wall folded over at side edge 7.

As shown, the front 10 and rear 11 faces are connected along the top edge 4 by a heat seal 12. In this embodiment, the front 10 and rear 11 faces are connected via a gusset portion 13 of conventional form for drinks pouches to provide the bottom portion 5. In an alternative embodiment, the gusset may be omitted, the front 10 and rear 11 faces simply being heat sealed together along a bottom edge.

Side edge 6 is formed by a heat seal 14 connecting the front and rear faces and running from the top edge 4 to the bottom portion 5. A further heat seal 15 connecting the front 10 and rear 11 faces extends from the top edge generally in a direction towards the bottom portion 5 parallel to and spaced from the heat seal 15. It will be seen that heat seal 15 has the effect of dividing the interior of the cavity 9 into major 16 and minor 17 portions. As the heat seal 15 terminates short of the bottom portion, the major 16 and minor 17 portions of cavity 9 remain interconnected so that drink may continue to flow between them. The minor portion 17 lies between the heat seals 14 and 15, and defines a space in which straw 3 is located. The heat seal 15 does not need to be continuous. If formed with gaps (not shown) interrupting it, drink may flow through the gaps.

Corner portion 8 is openable along a line of weakness 18 formed in the pouch and extending generally parallel to the top edge 4 from a notch 19 cut into the heat seal 14 to and ending at the heat seal 15. The top edge need not be straight, as here, but could be curved in a simple or complex manner. In that case, line of weakness 18 will be generally parallel to the bottom portion 5. The line of weakness 18 may be formed both in the respective external faces of the front face 10 and in the rear face 11 of the pouch generally parallel to the top edge 4 (or to the bottom portion if the top edge is not straight) from the first heat seal 14 to and ending at the second heat seal 15, the line of weakness being formed as dotted or dashed lines 18 laser etched into the exterior surfaces of the front and rear faces. This allows the corner portion 8 to be removed as a whole from the remainder of the pouch by tearing along the laser etched lines either from side edge 7 to the cut 20 or from the cut 20 to the side edge 7. Removal of corner portion 8 exposes an end of the straw 3.

In this embodiment, heat seal 12 defining the top edge 4 is interrupted by a cut 20 at heat seal 15 to form a minor heat seal portion 21 extending from heat seal 14 to heat seal 15 and a major heat seal portion 22 separated from the minor heat seal portion 21 by cut 20 and extending from heat seal 15 to side edge 7. In effect, the heat seal 15 is bifurcated at its end adjacent the top edge to form one branch 15*a* extending to minor heat seal portion 21 in the corner portion 8 and a second branch 15*b* extending to the remainder of heat seal 12 in major heat seal portion 22, the cut 20 extending between the two branches. In addition a notch 23 similar to notch 19 is cut into the edge of branch 15*a* at the bottom of cut 20. As a result, corner portion 8 is removable from the remainder of the pouch 1 by tearing along the line of weakness 18 from side edge 6 to the cut.

The major advantage of the described construction is that the line of tear is well defined, and the risk of any tear continuing beyond heat seal 15 is greatly reduced. A user will readily locate the straw 3 and be able to draw drink from the cavity 9 without significant risk of spillage.

Figure 4:
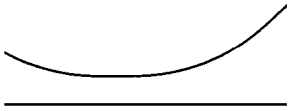
FIG. 4 is a somewhat schematic front elevational view of an alternative embodiment of filled pouch.

Turning now to FIG. 4, this figure shows a front elevational view similar to that of FIG. 1, for a second embodiment of pouch, using like reference numerals for like parts where appropriate. In this arrangement, the straw is fixed in position within the minor portion 17 of cavity 9 by a portion 24 intermediate its ends being bonded to an interior surface of the cavity 9 which may be a surface of the laminate form front face 10 or of laminate form rear face 11, or of both. The bonded portion 24 may be continuous or formed as several discrete portions. As shown, the straw also includes a longitudinally expandable portion 25 positioned between the intermediate position 24 and the top edge 4. As a result, after opening the corner portion, a user may readily locate the straw 3 and extend its end beyond the top edge by expanding the expandable portion 25 longitudinally, and thus be able to draw drink from the cavity 9 without significant risk of spillage. The expandable portion is suitably formed as a concertina section. It will be understood that an expandable portion 25, preferably a concertina section could be employed without the straw necessarily being bonded to one or both internal surfaces of the pouch walls.

Figure 5:
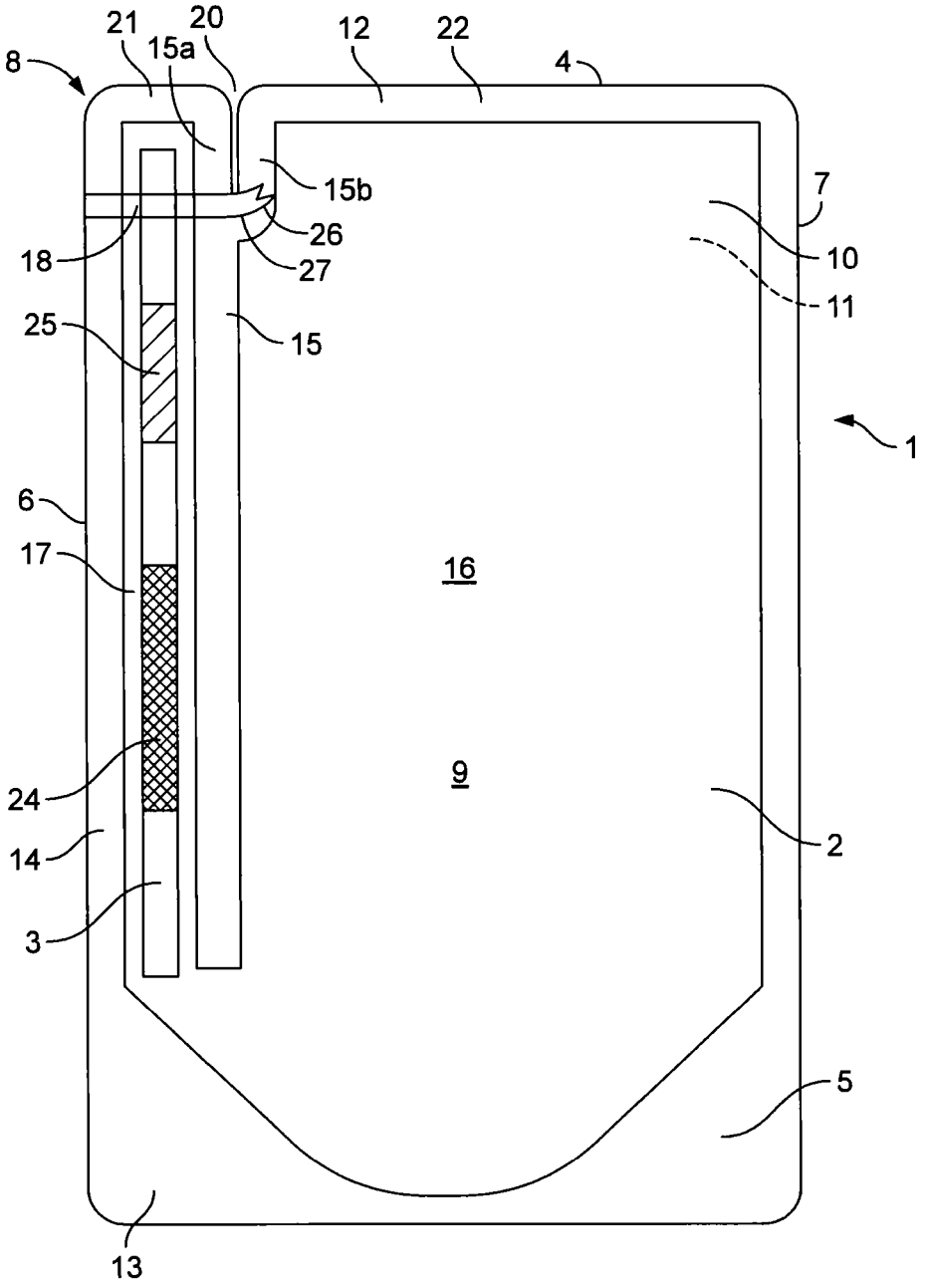
FIG. 5 is a view similar to FIGS. 1 and 4 for a further embodiment.

FIG. 5 shows a similar front elevational view of another embodiment, again with like reference numerals being employed for like parts where appropriate. In this embodiment, the line of weakness 18 is defined by an elongate tear strip 26, suitably formed of a flat polymer strip whose material is more resistant to tearing than the remaining material of the film, and is incorporated into that material to extend along the line of weakness 18 at least from a position at or adjacent the first heat seal 14 to a position at or adjacent to the second heat seal 15, the tear strip 26 having a graspable free distal end portion 27 extending out of the remaining material of the pouch, whereby the corner portion can be opened by pulling the free distal end portion 27 to tear the remaining material of the pouch along the line of weakness 18. The tear strip 26 may be incorporated into the film during its formation as a laminate of different layers between such layers. Rather than being formed as a flat polymer strip, tear strip 26 may be string-like, being of woven or twisted thread form.

In some arrangements, the tear strip 26 extends only from first heat seal 14 to the second heat seal 15 on one face of the pouch along the line of weakness 18, and exits the remaining material of the pouch at or adjacent the second heat seal 15 to provide said distal end portion 27. Pulling on the distal end portion 27, in a direction from right to left in the Figure, will have the effect of tearing the pouch along the line of weakness 18 on only one face. The end result leaves the corner portion 8 open so that the straw 3 can be located to allow a user to drink from the pouch via the straw, but with the corner portion not fully removed from the pouch. In an alternative arrangement, the tear strip 26 extends from a position at or adjacent the second heat seal 15 on one of the front face and the rear face to a position at or adjacent the first heat seal 14, and then to a position at or adjacent the second heat seal 15 on the other face of the pouch, and exits the remaining material of the pouch on this other face at or adjacent the second heat seal 15 to provide the distal end portion 27. In this case pulling on the distal end portion may have the effect of removing the corner portion entirely. The notches 19 and 20 at the ends of the line of weakness 18, as described and illustrated in earlier described embodiments will assist in terminating the torn portion, and in preventing the tear running into the remainder of the pouch with a risk of spillage, especially when the pliant material from which the pouch is formed is relatively weak. Where such material is more resistant to tearing, although necessarily still less resistant to tearing than the tear strip 26 in the present disclosure, the ends of the strip may define end points for the resultant tear.

In this described embodiment, as with previously described embodiments, the major advantage of the described construction is that the line of weakness is well defined, and the risk of any tear continuing beyond heat seal 15 defining the boundary of corner portion 8 is greatly reduced.

The extent of the tear may be limited in other ways.

Figure 6:
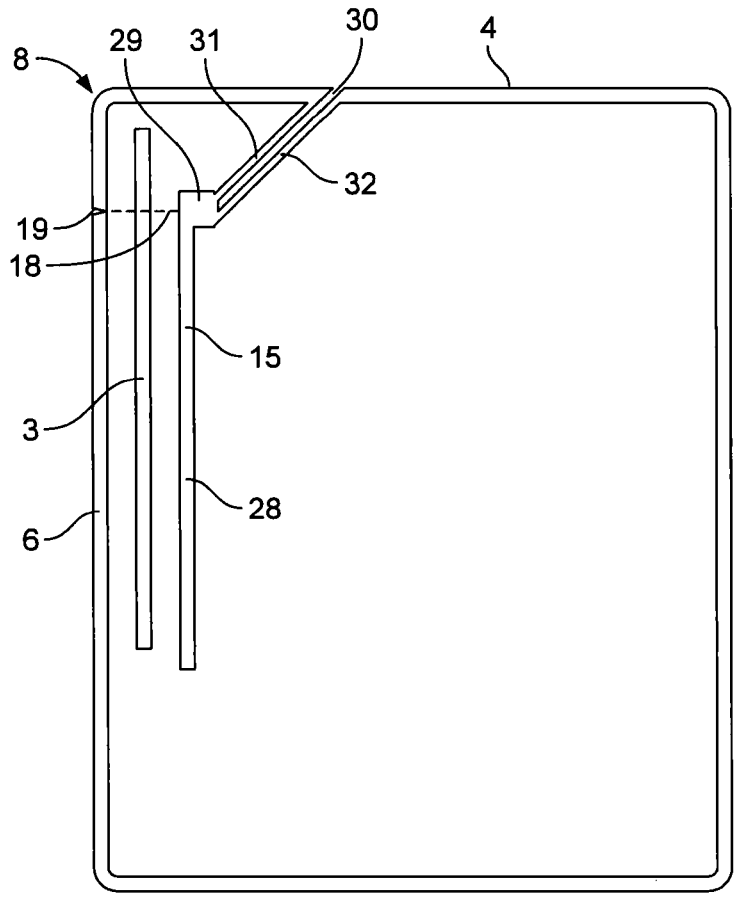
FIGS. 6 and 7 are similar views, sealed and with opened corner portion for another embodiment.
Figure 7:
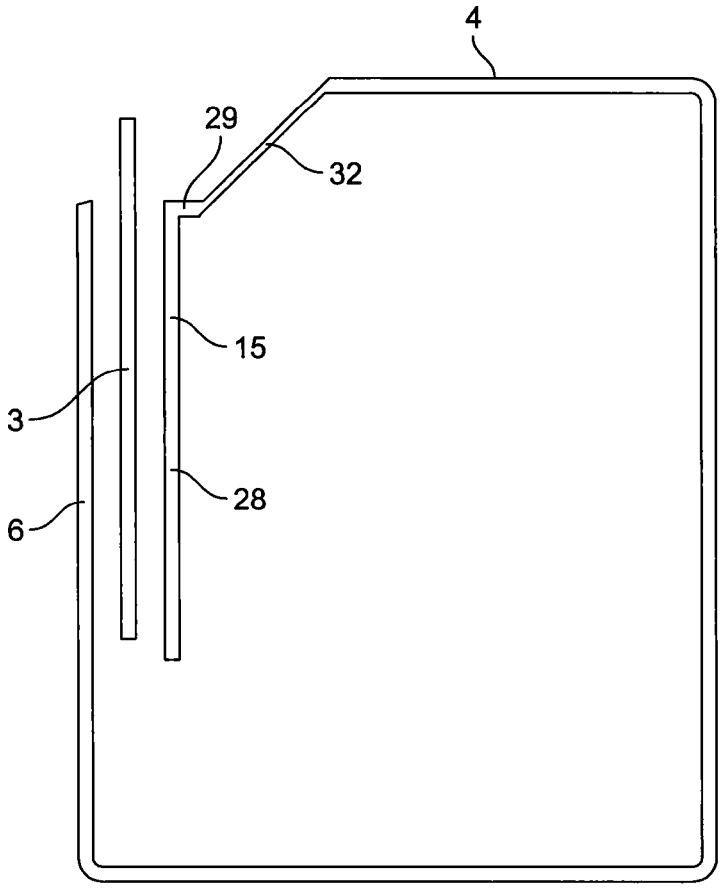

Reference may be made to FIGS. 6 and 7, which respectively show a somewhat schematic front elevational view of another embodiment of drinks pouch in the fully sealed condition and with the corner portion removed. Like reference numerals are employed for like parts. It will be apparent that the second heat seal 15 is not straight. Main portion 28 terminates at its upper end in an enlarged abutment 29 connecting the front and rear walls. A cut 30 extends from the abutment to the top edge 4 at an angle, sealed on either side by secondary seals 31 and 32. Line of weakness 18 extends from side edge 6 at notch 19 to the abutment 29 which serves as an anchor to terminate a tear along the line of weakness. After tearing along the line of weakness from notch 19 to abutment 29, the corner portion 8 may be detachable as a whole from the remainder of the pouch or be left to hang down from abutment 29 allowing access to straw 3 without the corner portion getting in the way.

Figure 8:
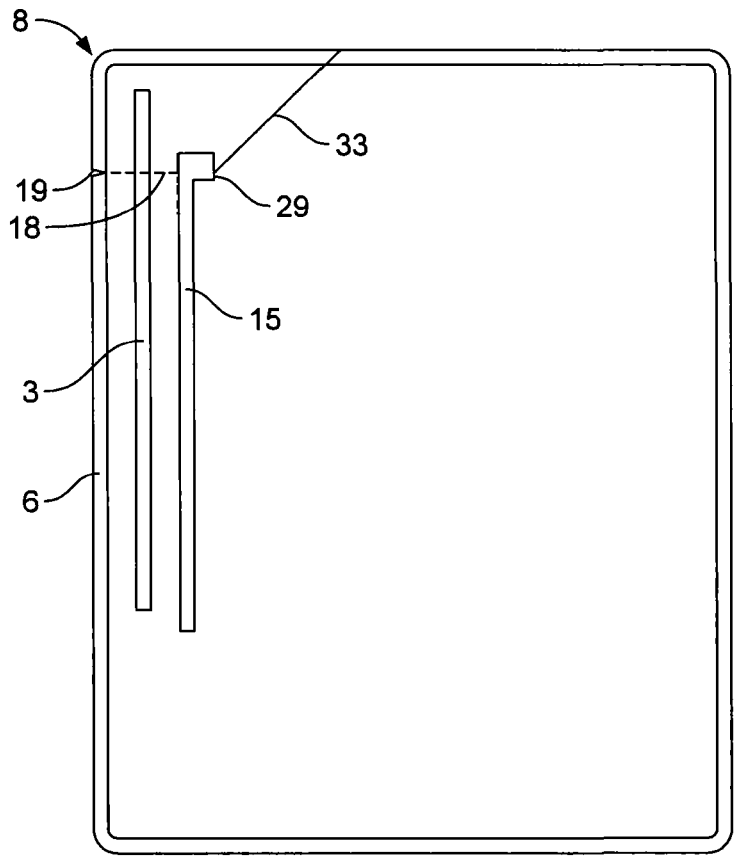
FIG. 8 is a view similar to FIG. 6 for yet another variant.

The somewhat schematic front elevational view of FIG. 8 shows another arrangement in which the line of weakness is terminated at an abutment 29 at the upper end of second seal 15. Instead of a cut 30 extending from abutment 29 to the top edge 4, this embodiment features a fold line 33. Having made a tear from notch 19 on side edge 6 along the line of weakness 18 to terminate at abutment 29, the partially detached corner portion 8 can simply be folded out of the way along line 33.

Figure 9:
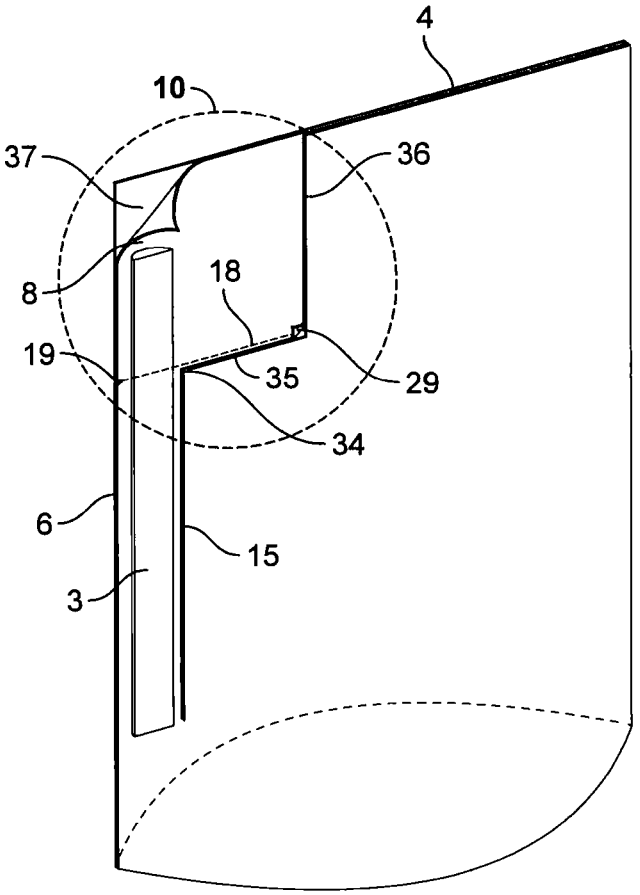
FIGS. 9 and 10 show yet another alternative in perspective and in an enlarged scrap view.
Figure 10:
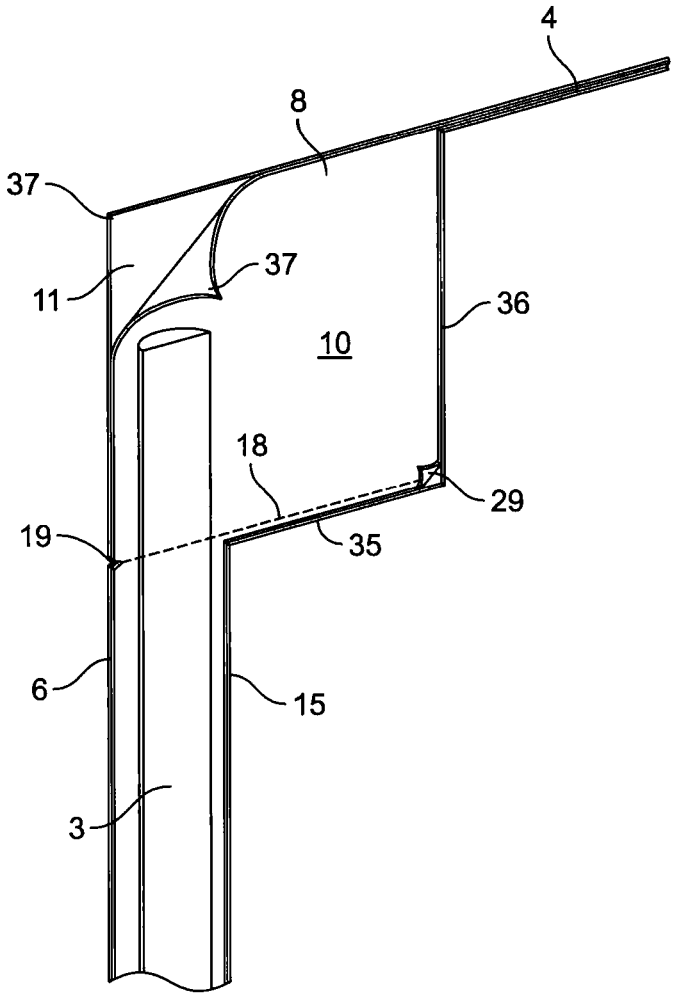

FIG. 9 and the enlarged corner view of FIG. 10 illustrate a further possibility featuring a peel off opening of the corner portion. Again, where appropriate, like reference numerals are employed for like parts. Whereas the heat seals in all other portions of the pouch are durable, in this embodiment the strength of the heat seals in the corner portion 8 are significantly weaker than elsewhere on the pouch, as explained below. In this embodiment the main portion of second heat seal 15 has an upper end 34 at the edge of the corner portion 8 immediately adjacent to line of weakness 18, then extends along a line 35 alongside the line of weakness to terminate at an abutment 29 connecting the front and rear walls of the pouch. The line of weakness 18 extends from notch 19 at side edge 6 to terminate at abutment 29. A secondary heat seal 36 extends from abutment 29 to top edge 4. Secondary heat seal 36 may be parallel to the first heat seal 14 and to the second heat seal 15, may extend at an angle from abutment 29 to top edge 4 similar to secondary seals 31 and 32 in FIGS. 6 and 7, or may extend along a curve. The portions of heat seal 12 along the top edge 4 from secondary heat seal 36 to corner 37 of corner portion 8 and of first heat seal 14 along the side edge 4 from notch 19 to corner 37 of corner portion 8 have significantly less strength that the remaining heat seals. As a result, the front wall 10 is readily separable from the rear wall 11 in corner portion 8 by peeling them apart from the corner 37 as schematically illustrated in FIG. 10. When the peel reaches the line of weakness 18, which in this embodiment need only be in the front wall 10, the front wall 10 in corner portion 8 is torn along line 18 from notch 19 to abutment 29, which serves as an anchor to terminate the tear. The resultant flap of front wall 10 remains attached to the remainder of front wall 10 along the line of secondary heat seal 36, but can readily be folded back to allow access to the straw 3. Especially if the straw 3 is fixed internally of the pouch to one or both of the front and back walls, but has an extendable portion (not illustrated), and, even more so, a concertina section allowing it both to be extended and bent, a user can easily drink from the pouch using the straw without the remaining rear wall in the corner portion getting in their way.

Those embodiments of our drinks pouches in which the corner portion is openable without being fully detached, and which incorporate a straw which is sealed to an internal wall of the pouch, have the collateral advantage that there is no detached corner portion or separate straw that may create a litter problem separate from the pouch. The evidence suggests that users are much more likely to dispose of an empty pouch in a litter bin than a torn off corner or a separate straw. Ensuring that the components of the pouch remain together as a single unit is of benefit to the environment in encouraging more responsible disposal of the used product.

The invention claimed is:

1. A fully sealed pouch containing a drink, and provided with a straw within the pouch accessible to allow a user to draw drink from the pouch;

the pouch defining a top portion, a bottom portion, and respective side edges interconnecting the top portion and the bottom portion, and a corner portion defined between the top portion and one said side edge, the corner portion being openable by a user to access the straw;

the pouch forming a closed cavity containing said drink, the cavity being defined by said top portion, said bottom portion, and said side edges and by at least one wall defining a front face and a rear face for the cavity, the front and rear faces being connected together in said top portion, the front and rear faces being continuous with each other at, or being connected along, the other of said side edges, the front and rear faces being connected, via a gusset, to provide said bottom portion, and said one side edge being formed by a first heat seal connecting the front and rear faces;

a second heat seal connecting the front and rear faces and extending in an incomplete fashion from the top portion to the bottom portion and being spaced inboard of the first heat seal, the second heat seal dividing the interior of the cavity into major and minor portions interconnected so that the drink may flow between them, the minor portion lying between the first and second heat seals, and the straw being located within said minor portion; and the corner portion being openable along a line of weakness formed in said pouch and extending generally parallel to the bottom portion from the first heat seal to and ending at the second heat seal, wherein the top portion has a top edge defined by a third heat seal extending from the one to the other of the side edges, the second heat seal terminates short of the top edge at an enlarged abutment connecting the front and rear faces, and the line of weakness extends from said one side edge and terminates at said abutment which forms an anchor for the line of weakness, whereby said corner portion is openable by tearing along said line of weakness from said one side edge to said abutment.

2. The pouch according to claim 1, wherein the top portion is provided with a fold line extending from said abutment to said top edge, whereby said corner portion remains attached to the remainder of the pouch along the fold line following tearing along said line of weakness, but may be folded out of the way along the fold line when a user accesses the straw to drink from the pouch.

3. The pouch according to claim 1, wherein the straw is bonded to said at least one wall, whereby the straw is fixed in position within the pouch at least until located by a user after opening the corner portion.

4. The pouch according to claim 1, wherein the pouch is formed from a heat bondable pliant packaging material in laminate form, and the straw has a first end and a second end and is bonded to at least one surface interior of the pouch selected from surfaces of said front and rear surfaces interior of the pouch at a portion of the straw intermediate its ends.

5. The pouch according to claim 4, wherein the first end of the straw is located adjacent the top portion of the pouch, and wherein the straw has a longitudinally expandable portion, preferably a concertina portion that also allows the straw to be bent, and wherein the expandable portion is located between said intermediate portion and the first end of the straw.

6. The pouch according to claim 1, wherein a first end of the straw is located adjacent the top portion of the pouch, and wherein the straw has a longitudinally expandable portion, preferably a concertina portion that also allows the straw to be bent.

7. A fully sealed pouch containing a drink, and provided with a straw within the pouch accessible to allow a user to draw drink from the pouch;

the pouch defining a top portion, a bottom portion, and respective side edges interconnecting the top portion and the bottom portion, and a corner portion defined between the top portion and one said side edge, the corner portion being openable by a user to access the straw;

the pouch forming a closed cavity containing said drink, the cavity being defined by said top portion, said bottom portion, and said side edges and by at least one wall defining a front face and a rear face for the cavity, the front and rear faces being connected together in said top portion, the front and rear faces being continuous with each other at, or being connected along, the other of said side edges, the front and rear faces being connected, via a gusset, to provide said bottom portion, and said one side edge being formed by a first heat seal connecting the front and rear faces;

a second heat seal connecting the front and rear faces and extending in an incomplete fashion from the top portion to the bottom portion and being spaced inboard of the first heat seal, the second heat seal dividing the interior of the cavity into major and minor portions interconnected so that the drink may flow between them, the minor portion lying between the first and second heat seals, and the straw being located within said minor portion; and the corner portion being openable along a line of weakness formed in said pouch and extending generally parallel to the bottom portion from the first heat seal to and ending at the second heat seal, wherein the top portion has a top edge defined by a third heat seal extending from the one to the other of the side edges, the corner portion has a corner where the top edge and the one side edge meet, and wherein the strength of the first and third heat seals in the corner portion is substantially less than the strength of the remainder of the first and third heat seals, whereby the corner portion may be opened by peeling the front and rear faces apart at the corner in the corner portion along the lesser strength portions of the first and third seals, and tearing along the line of weakness, to leave the peeled apart portions of the front and rear faces still attached to the remainder of the pouch.

8. A pouch containing a drink, and provided with a straw within the pouch accessible to allow a user to draw drink from the pouch;

the pouch defining a top edge, a bottom portion, and respective side edges interconnecting the top edge and the bottom portion, and a corner portion defined between the top edge and one said side edge, the corner portion being openable by a user to access the straw;

the pouch forming a closed cavity containing said drink, the cavity being defined by said top edge, said bottom portion, and said side edges and by at least one wall defining a front face and a rear face for the cavity, the front and rear faces being connected along said top edge, the front and rear faces being continuous with each other at or being connected along the other of said side edges, the front and rear faces being connected, via a gusset, to provide said bottom portion, and said one side edge being formed by a first heat seal connecting the front and rear faces;

a second heat seal connecting the front and rear faces, and extending from an enlarged abutment joining the front and rear faces at a position short of the top edge generally in a direction towards the bottom portion parallel to and spaced from the first seal, the second seal dividing the interior of the cavity into major and minor portions interconnected so that the drink may flow between them, the minor portion lying between the first and second seals, and the straw being located within said minor portion; and a line of weakness formed in said pouch and extending generally parallel to the bottom edge from the first heat seal to and terminating at the abutment which forms an anchor for the line of weakness, whereby said corner portion is openable by tearing along said line of weakness from said one side edge to said abutment.

9. The pouch according to claim 8, wherein a fold line extends from said abutment to said top edge, whereby said corner portion remains attached to the remainder of the pouch along the fold line following tearing along said line of weakness, but may be folded out of the way along the fold line when a user accesses the straw to drink from the pouch.

* * * * *